US005545081A

United States Patent [19]

Haffely et al.

[11] Patent Number: 5,545,081

[45] Date of Patent: Aug. 13, 1996

[54] TOOL FIXTURE FOR ABRADING APPARATUS

[75] Inventors: Jeffrey L. Haffely, Gibsonia; Xun Lei, Cheswick; Louis C. Brickner, Pittsburgh, all of Pa.

[73] Assignee: Delta International Machinery Corp., Pittsburgh, Pa.

[21] Appl. No.: 286,358

[22] Filed: Aug. 9, 1994

[51] Int. Cl.[6] ..... B24B 19/00

[52] U.S. Cl. ..... 451/367; 451/369

[58] Field of Search ..... 451/365, 367, 451/368, 369, 372, 278, 279, 293; 269/156, 224

[56] References Cited

U.S. PATENT DOCUMENTS

| | | | |
|---|---|---|---|
| 981,810 | 1/1911 | Sterling | 451/369 |
| 1,063,391 | 6/1913 | Rodgers | 451/369 |
| 1,086,239 | 2/1914 | Stover | 451/369 |
| 1,206,791 | 12/1916 | Anderson | 451/369 |
| 1,293,751 | 2/1919 | Garrison | 451/369 |
| 2,753,666 | 7/1956 | Sasse | 451/365 |
| 2,922,263 | 1/1960 | Bogert | 451/367 |
| 3,881,888 | 5/1975 | Schwab | 451/367 |
| 4,229,909 | 10/1980 | Dial, Sr. | 451/367 |
| 5,148,632 | 9/1992 | Adler et al. | 451/278 |

OTHER PUBLICATIONS

Delta Industrial Machinery Brochure, pp. 0–4, Printed Jan. 1, 1994.

Makita Electric Works, Ltd., Instruction Manual for Makita Sharpener, 1985.

Makita Electric Works, Ltd., Brochure, p. 73 Publication Date unknown.

Sharp Edges the Easy Way, *Wood News* 25, printing date unknown.

Reliant, Instruction Manual for Model Nos. GGM–250B and GGM–250N Bench Dry/Wet Grinder, Printing date unknown.

Delta International Machinery Corp., Instruction Manual for Universal Wet/Dry Grinder, 1988.

Delta International Machinery Corp., Brochure, pp. 72–79, Printing date unknown.

*Primary Examiner*—Bruce M. Kisliuk
*Assistant Examiner*—Dona C. Edwards
*Attorney, Agent, or Firm*—Kirkpatrick & Lockhart LLP

[57] ABSTRACT

An apparatus for holding a tool having a cutting edge in a predetermined abrading orientation with respect to a tool abrading apparatus. The apparatus comprises a base member supportable on the tool abrading apparatus and adapted to support a tool thereon. A positioning member is movably attached to the base member for selective abutting contact with the tool. An adjustment assembly is attached to the base member for selectively advancing and retracting the positioning member relative to the base member to position the tool into the predetermined abrading orientation. A tool retaining member is removably attached to the base to selectively retain the tool on the base member in the predetermined abrading orientation.

12 Claims, 6 Drawing Sheets

TOOL FIXTURE FOR ABRADING APPARATUS

BACKGROUND OF THE INVENTION

1. Field of the Invention

The present invention relates to tool abrading and sharpening apparatuses and, more particularly, is directed to fixtures for holding blades, tools, etc. in an abrading or sharpening position on a grinding device that utilizes abrasive grinding mediums.

2. Description of the Invention Background

A number of modern tools and machines include portions having engageable edges which must be kept free from surface imperfections such as, for example, burrs, nicks and gouges, so that the tool or machine can function properly. For purposes of the present disclosure, such an operation will be referred to as "grinding". Such tools which should be free from surface imperfections include, for example, flathead screwdrivers, chisels, gouges, the cutter members of planes, spokeshaves and scrapers, and the knife members of planer machines and jointer machines. With respect to those tools which are used to remove wood from a workpiece, the presence of such surface imperfections can mar or gouge the wood surface, requiring additional time and sanding operations to obtain an acceptable appearance for the workpiece.

In addition to the removal of surface imperfections, a number of tools and machines include edges which must be kept sharp so that the tool or machine can properly cut or remove a material of interest. For purposes of this disclosure, the operation of providing a tool with a sharp edge will be referred to as "sharpening". Such tools which must be kept sharpened include, for example, all types of knife tools, woodworking chisels and gouges, and the knife blades of planer machines and jointer machines. The action of either grinding or sharpening, as well as any other activity where material is removed from a surface, will be referred to herein as "abrading".

Perhaps the most rudimentary means for maintaining an edge free from burrs and nicks and/or to sharpen the edge is to use a stone surface, known as a whetstone, oilstone or a bench stone. Such stones may be composed of natural stone or artificial material such as silicon carbide or aluminum oxide, and come in a variety of grits. By repeated stroking of the worn edge on the stone at the proper angle, material is abraded from the edge surface. To remove surface imperfections from the edge, or to straighten the edge, a stone having a coarse or medium grit size is used. To sharpen to the edge, a stone having a relatively fine grit size is employed. To properly sharpen an edge, oftentimes both procedures must be employed so that gross surface imperfections are first removed from the edge using a medium or coarse grit stone, and then the edge may then be sharpened using a relatively fine grit stone.

When sharpening an edge by subjecting the edge to one or both of the above abrading steps, a constant angle should be maintained between the tool and the abrading surface so that the edge is not sharpened in a rounded configuration. Maintaining a constant angle when sharpening by hand using a stone is quite difficult, in part because the tool must be stroked across the stone surface while maintaining substantially constant pressure between the edge and the stone.

To hasten the removal of material from the edge to be maintained and also to aid in maintaining a proper angle between the tool and the abrading surface, a variety of motor-driven grinding and sharpening devices are available. These devices may be capable of either grinding or sharpening, or may provide both features. Many of these abrading devices employ a wheel of a natural or synthetic abrasive material which is driven to rotate by an electric motor.

One such device is the Model GGM-250W grinding/sharpening machine distributed by Reliant, which incorporates an 80 grit grinding wheel which rotates on a horizontally-disposed axis, hereafter referred to as a "vertical grinding wheel", and a water-fed 800 grit sharpening wheel which rotates on a vertically-disposed axis, hereafter referred to as a horizontal sharpening wheel. Reliant is a tradename of Trendlines of Chelsea, Mass. Individual tool rests consisting of flat metal pieces are attached adjacent each wheel for resting the tool which is to be ground or sharpened thereon. The tool is placed on the tool rest and manually moved therealong to ensure the entire tool edge gets sharpened. This method of supporting the tool relative to the grinding wheels is fraught with many problems. In particular, because the tool is manually restrained on the tool rest during the sharpening process, the uniformity of the sharpened edge is entirely dependent upon the operator's ability to uniformly introduce the entire edge to be sharpened to the abrasion surface. If the operator applies more pressure to one portion of the edge, that portion may have more material removed therefrom. In addition, often times during the sharpening operation, if the tool is not uniformly introduced to the abrasion surface, the tool will "kick back" away from the grinding wheel thereby endangering the operator and others that may be located in the surrounding area. Also, because the tool rest of the Reliant machine comprises a flat metal strip supported at its terminal ends, the strip may bow if the tool is pressed onto it with sufficient force. The bowing of the strip will affect the elevation and angle of the blade relative to the abrading surface and may also affect the pressure exerted on the abrading surface by the edge being sharpened. American Machine & Tool Co., Inc. ("AMT"), Royersford, Penn. and Woodtek Machinery, which is a tradename of Woodworker's Supply of Albuquerque, New Mex., distribute grinding/sharpening machines which are similar in design as the Reliant machine and, thus, have the same disadvantages as the Reliant machine.

In addition to the above devices, Makita Electric Works, Ltd., Aichi, Japan, distributes a Model 9820-2 sharpening machine which includes a single sharpening station having a 1000 grit, water-fed, horizontal sharpening wheel. Disposed adjacent the wheel is a tool rest including a support rail having a surface for accepting a tool holder for sharpening.

The tool holder comprises a plate member adapted to be movably supported on the support rail. The blade to be sharpened is positioned on the plate member by four "forward adjust" screws that are threadedly attached to the rear portion of the plate member. A blade clamping plate is secured to the plate member by four blade fastening screws that are threaded into the plate in a position that is somewhat perpendicular to the forward adjust screws.

To position the blade on the tool holder, the forward adjust screws are unscrewed to permit the heel of the blade to contact the blade fastening screws. The blade fastening screws are then lightly tightened and the holder is then placed on the support rail. The right forward adjust screw is then advanced until the right upper edge of the blade contacts the grinding wheel. Thereafter, the far right fastening screw is tightened. The holder is then slidably positioned on the support rail such that the left end of the blade is above the grinding wheel. The left forward adjust screw is then advanced until the left upper edge of the blade contacts the grinding wheel. Thereafter, all four blade fastening screws are tightened.

Thus, the Makita blade holder discussed above requires two adjustment screws to be adjusted to position the blade on the plate such that the blade is properly oriented relative to the grinding wheel when the blade holder is received on the support rail. Such blade adjustment arrangement is time consuming. In addition, there is no means for automatically retracting the forward adjust screws to accommodate wider blades.

As such, there is a need for a tool holder that can be used in connection with an abrading apparatus for safely and accurately supporting and orienting the tool relative to the abrading or grinding medium such that the tool can be uniformly sharpened along its entire length and can be easily adjusted to accommodate a variety of tools of various sizes.

SUMMARY OF THE INVENTION

In accordance with a particular preferred form of the present invention, there is provided an apparatus for holding a tool having a cutting edge in a predetermined abrading orientation with respect to a tool abrading apparatus. The apparatus preferably comprises a base member that is movably supportable on the tool abrading apparatus and adapted to support the tool thereon. A positioning member is movably attached to the base member for selective abutting contact with the tool. An adjustment assembly is attached to the base member for selectively advancing and retracting the positioning member relative to the base member to move the tool into the predetermined abrading orientation. A tool retaining member is removably attached to the base member for selectively retaining the tool in the predetermined abrading orientation.

The subject invention, in a preferred form, permits the position of the tool relative to the base member to be quickly and easily adjusted to a predetermined orientation by a singular adjustment screw. The subject tool fixture can be quickly adjusted to retain one or a plurality of tools in a predetermined orientation that permits the tools to be uniformly sharpened when the base member is received on the tool abrading apparatus. Also, because the positioning member is capable of being automatically retracted, the user does not have to retract the positioning member by applying a force to the cutting edge of each tool.

Accordingly, the present invention provides solutions to the aforementioned problems associated with prior tool fixtures. However, these and other details, objects and advantages will become apparent as the following detailed description of the present preferred embodiment thereof proceeds.

BRIEF DESCRIPTION OF THE DRAWINGS

In the accompanying drawings, there is shown a present preferred embodiment of the invention wherein like reference numerals are employed to designate like parts and wherein.

DETAILED DESCRIPTION OF PREFERRED EMBODIMENTS

Figure 1:
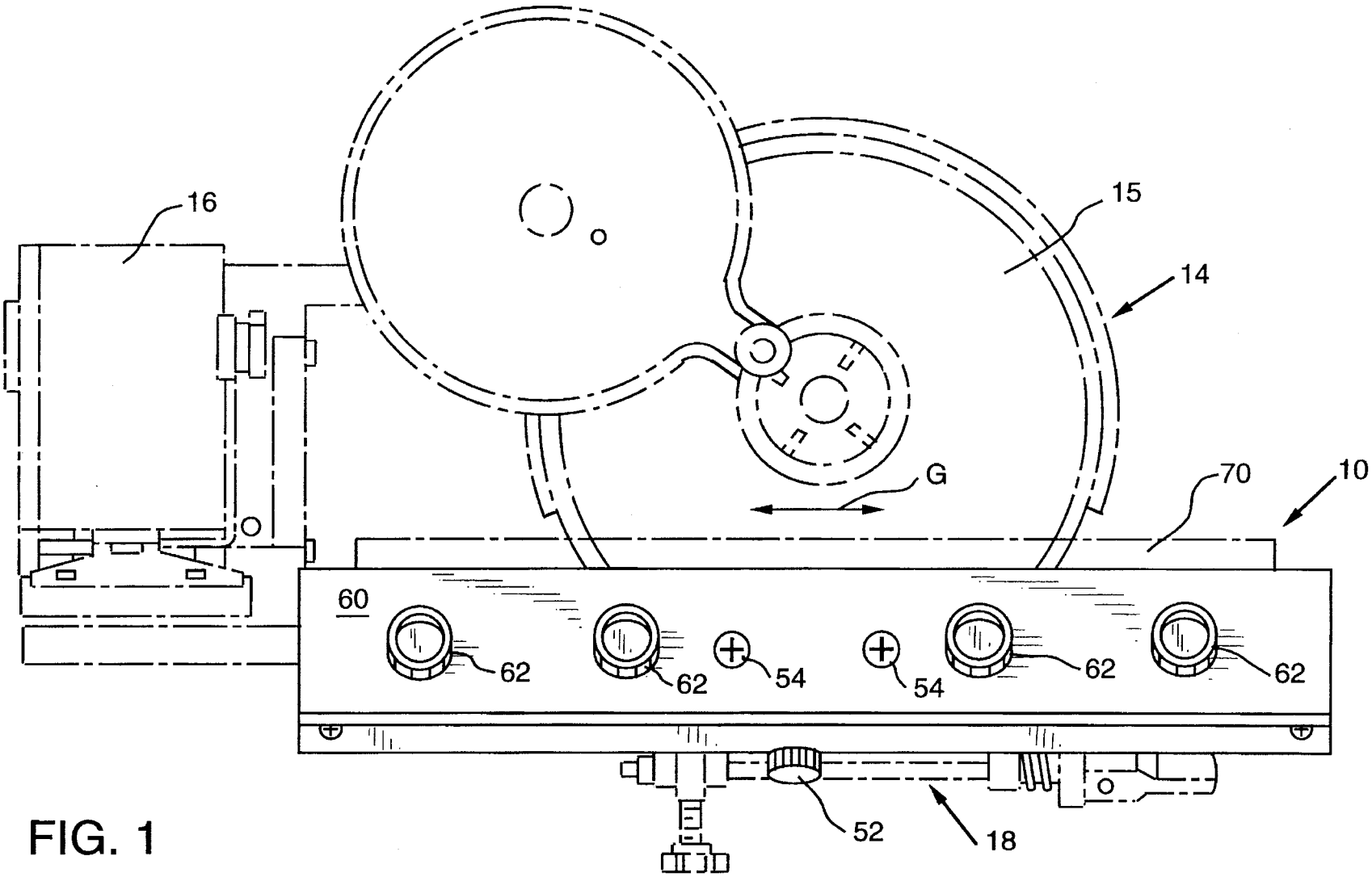
FIG. 1 is a plan view of a preferred tool fixture of the present invention supported on an abrading apparatus.

Referring now to the drawings for the purposes of illustrating a present preferred embodiment of the invention only and not for purposes of limiting the same, the Figures show a tool fixture generally designated as 10 that is adapted to support at least one tool in a predetermined abrading orientation. As the present Detailed Description of Preferred Embodiments continues, the reader will appreciate that the present tool fixture 10 is well- suited for supporting and orienting a blade or blades, such as those used in wood planers or jointers.

Figure 2:
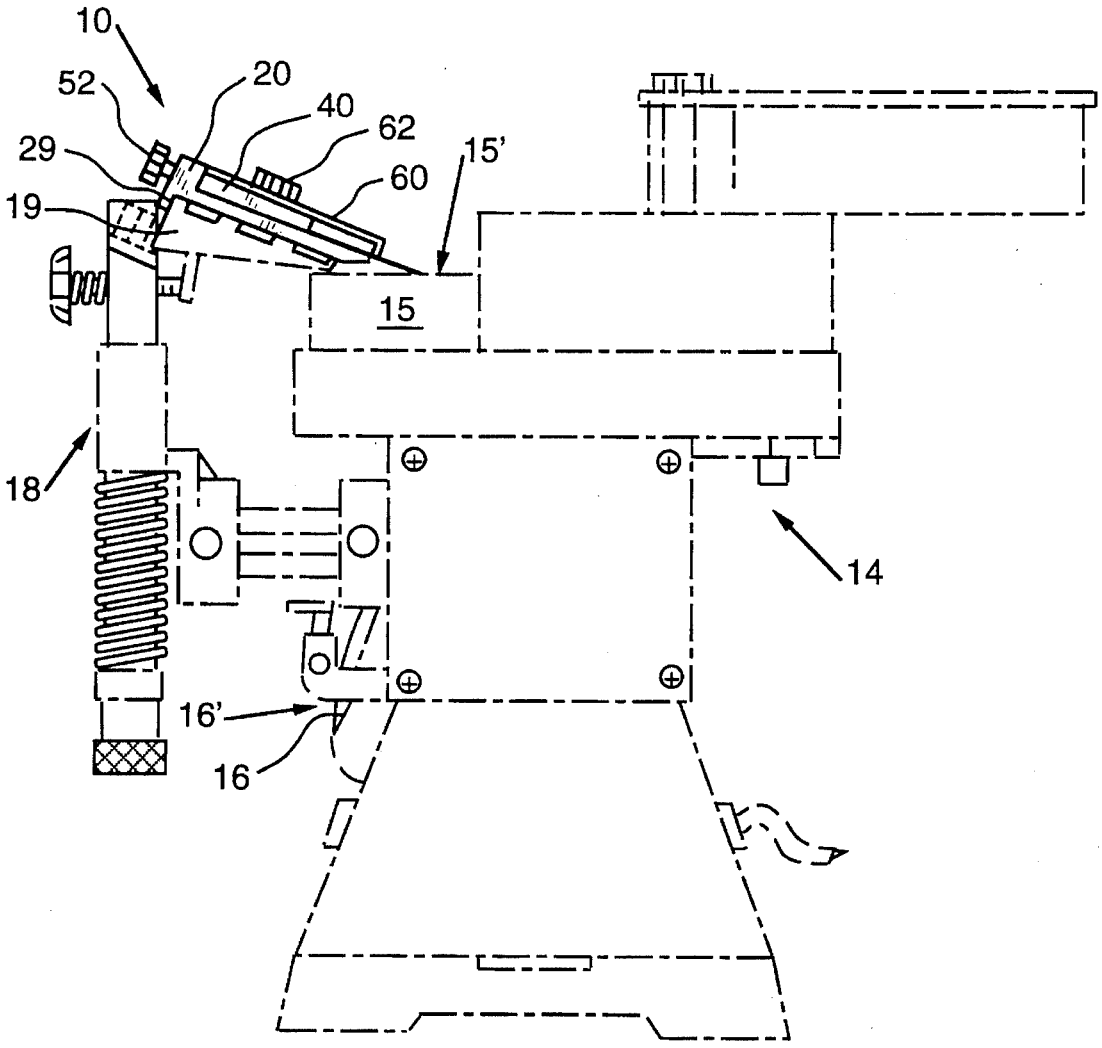
FIG. 2 is a right side elevational view of the tool fixture and abrading apparatus of FIG. 1.

For example, as shown in FIGS. 1 and 2, the present tool fixture 10, in a preferred form, is well-adapted for use in connection with a tool sharpening apparatus 14 that employs abrasive grinding wheels 15 and 16. The sharpening apparatus 14 is also equipped with a tool platform 18 that has a tool rest member 19 thereon adapted to support the tool fixture 10 in a tool abrading position. While the present tool fixture 10 is particularly well-suited for use with the unique tool platform 18 and abrading machine 14 that are the subject of our co-pending U.S. patent application Ser. No. 08/286,375, entitled "Adjustable Tool Platform And An Abrading Machine Including The Same", the disclosure of which is herein incorporated by reference, the skilled artisan will appreciate that the present tool fixture 10 can be used in connection with a variety of other tool platform/rest arrangements and abrading machines without departing from the spirit and scope of the present invention.

Figure 6:
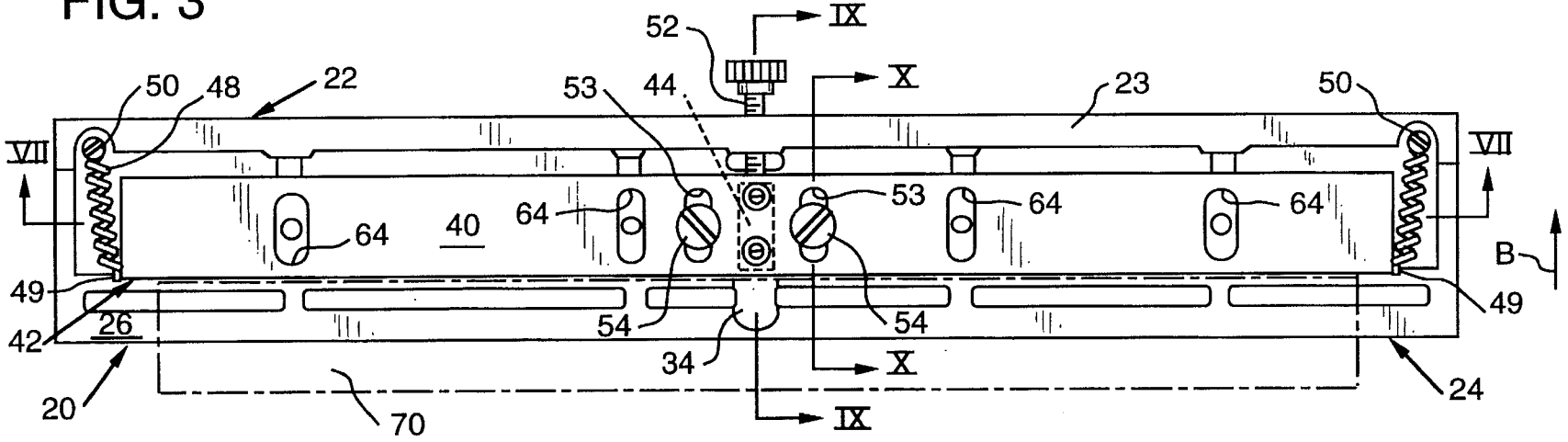
FIG. 6 is a top assembly view of the tool fixture of FIG. 3 with the clamping plate thereof removed for clarity.
Figure 4:
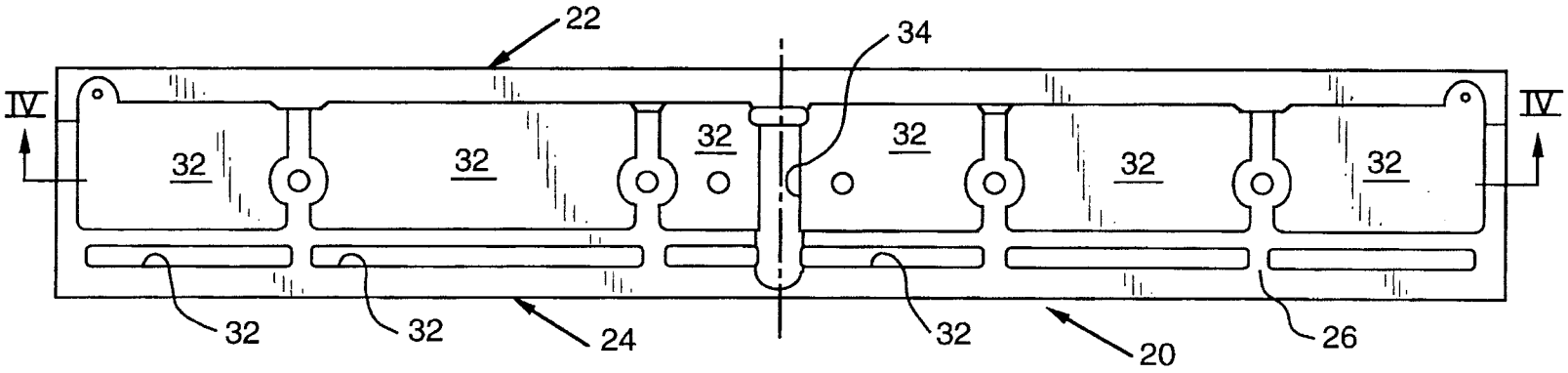
FIG. 4 is a top view of a preferred base plate of a tool fixture of the present invention.
Figure 5:
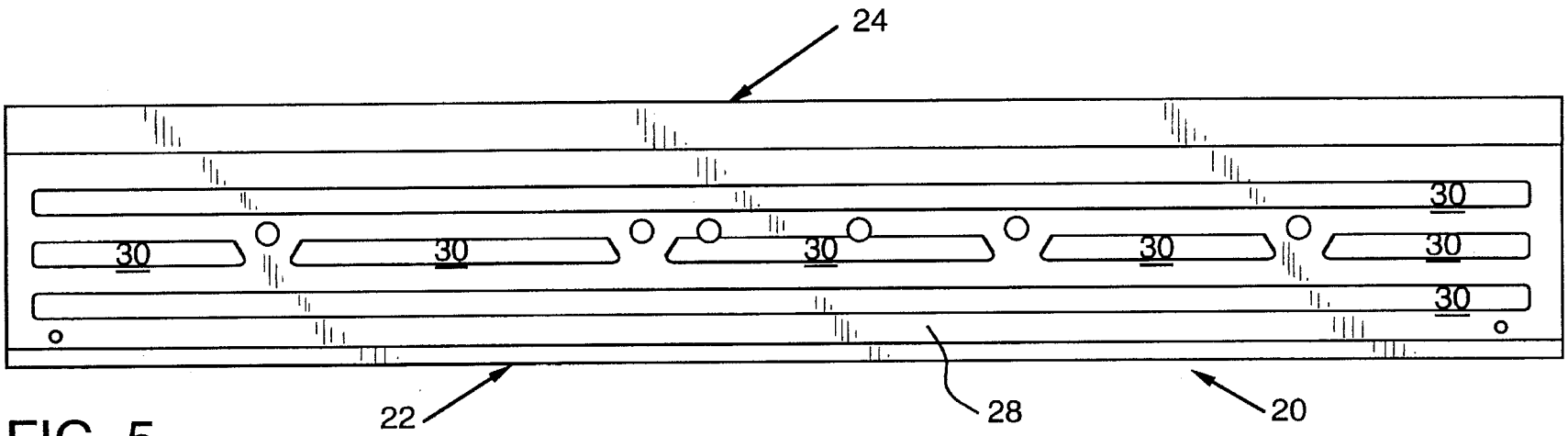
FIG. 5 is a bottom view of the base plate of FIGS. 3 and 4.

The present tool fixture 10, in a preferred form, comprises a base plate 20, a positioning member 40, and a retaining plate 60. As can be seen in FIGS. 4–6, the base plate 20 has a rear portion 22, a front portion 24, an upper surface 26 and a lower surface 28. In this embodiment, the base plate is preferably fabricated from cast iron and has a downwardly extending guide tab 29 formed in the rear portion 22 for orienting and slidably retaining the base plate 20 on the tool rest member 19 of the tool platform 18 in a manner that will be discussed in further detail below. In addition, as illustrated in FIG. 5, the lower surface 28 of the base plate 20 preferably has a plurality of recesses 30 machined therein to reduce the surface area that contacts the tool rest member 19 of the abrading apparatus 14 to thereby reduce the sliding friction created therebetween during the abrading operation. The skilled artisan will readily appreciate that the configuration and operation of the tool platform 18 and rest member 19 thereof being employed will generally dictate the configuration of the base plate 20. Thus, other base plate arrangements and configurations may also be successfully used.

Figure 7:
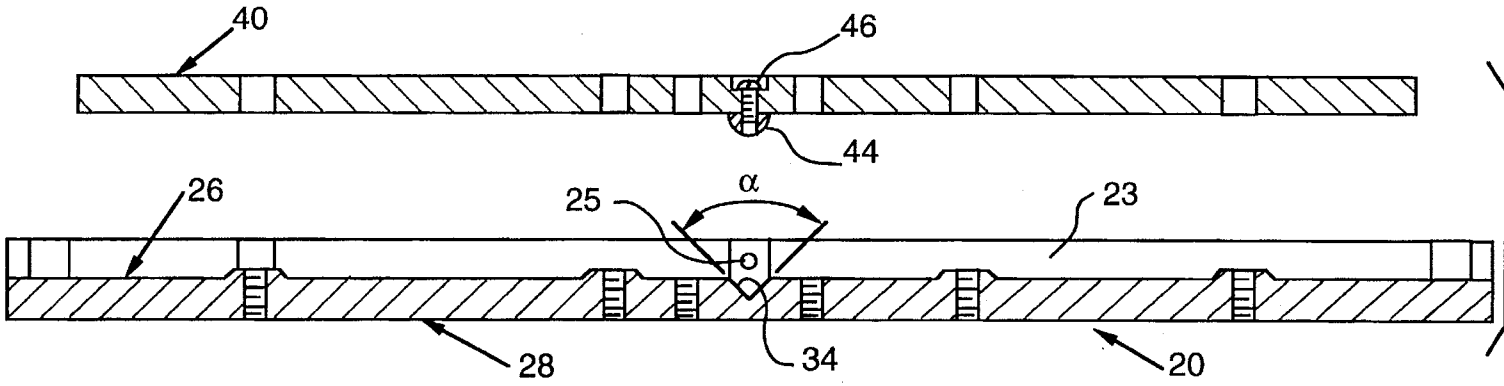
FIG. 7 is a partial cross-sectional exploded assembly view of a base plate and slider plate assembly taken along line VII—VII in FIG. 6.
Figure 8:
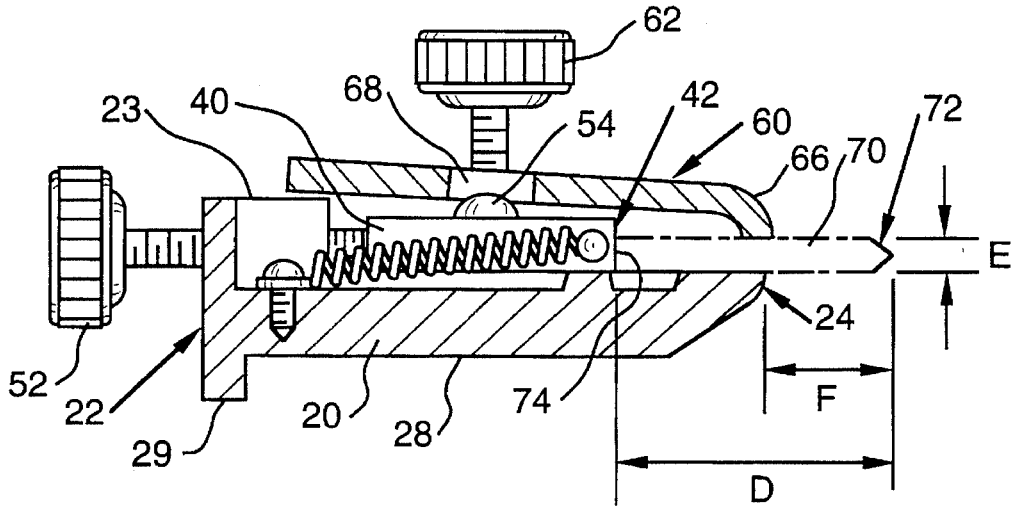
FIG. 8 is a left side elevational view of the tool fixture of FIG. 3 with some of the elements thereof shown in cross-section.
Figure 9:
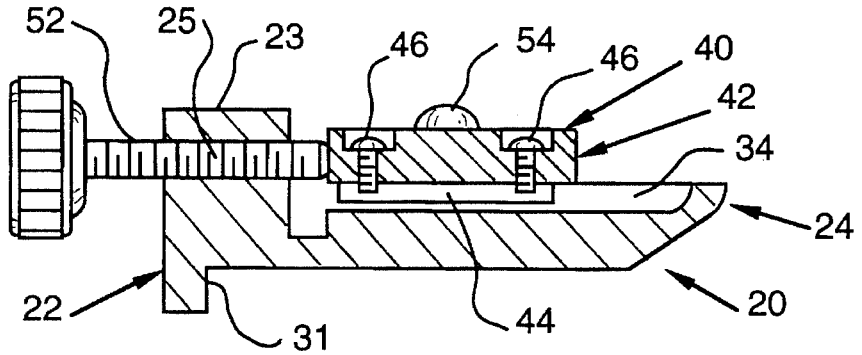
FIG. 9 is a cross-sectional elevational view of a preferred tool fixture with the clamping plate thereof removed taken along line IX—IX in FIG. 6.
Figure 10:
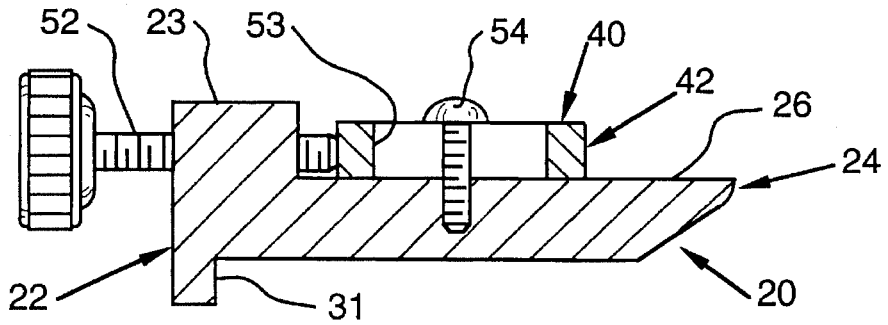
FIG. 10 is a cross-sectional elevational view of a preferred tool fixture with the clamping plate thereof removed taken along line X—X in FIG. 6.

As shown in FIGS. 6–10, a positioning member 40 is slidably received on the upper surface 26 of the base plate 20 for positioning a tool 70 thereon. Preferably, a plurality of recesses 32 are machined into the upper surface 26 of the base plate 20 to reduce the surface area thereof and thereby reduce the amount of sliding friction that is created when the positioning member 40 is slidably displaced on the upper surface 26. In addition, to guide the positioning member 40 on the upper surface 26, a "V" groove 34 is preferably provided in the upper surface 26 of base plate 20 as shown in FIGS. 4, 7, and 9. The "V" groove 34 is preferably shaped as shown in FIG. 7, with angle "α", equalling approximately 90°; however, the reader will appreciate that other groove shapes/arrangements may also be used.

The positioning member 40 preferably comprises an elongated piece of steel that has an abutment edge 42 for engaging and positioning the tool on the base plate 20. An alignment member 44, preferably fabricated from a piece of steel round stock sized to be slidably received in the groove 34 is preferably attached to the underside of the positioning member 40 by counter sunk screws 46. See FIGS. 7 and 9. However, the alignment member 44 can be attached to the positioning member 40 by other known fastening means.

As can be seen in FIGS. 6 and 8, the positioning member 40 is preferably biased in a rearward direction (depicted by arrow "B" in FIG. 6) by a pair of tension springs 48. Preferably, one end of each tension spring 48 is attached to a corresponding lateral end of the positioning member 40 by a pin member 49. The opposite ends of each spring 48 are attached to the rear portion 22 of the base plate 20 by screws 50.

Also in a preferred embodiment, the base plate 20 is equipped with a singular advancement screw 52 for selectively positioning the positioning member 40 on the base plate 20. As can be seen in FIGS. 6–10, the rear portion 22 of the base plate 20 has an upwardly extending wall portion 23. A tapped bore 25 extends through the central portion of the wall 23 to enable the advancement screw 52 to be threadedly received therein and ultimately contact the rear edge of the positioning member 40. See FIG. 8. The reader will appreciate that the single advancement screw 52 enables the positioning member 40 to be selectively positioned on the base plate 20 to accommodate different sized tools in a manner that will be discussed in further detail below. After the positioning member 40 has been advanced to the desired position, it can be retained in that position by screws 54 that extend through corresponding slots 53 in the positioning member 40.

Figure 3:
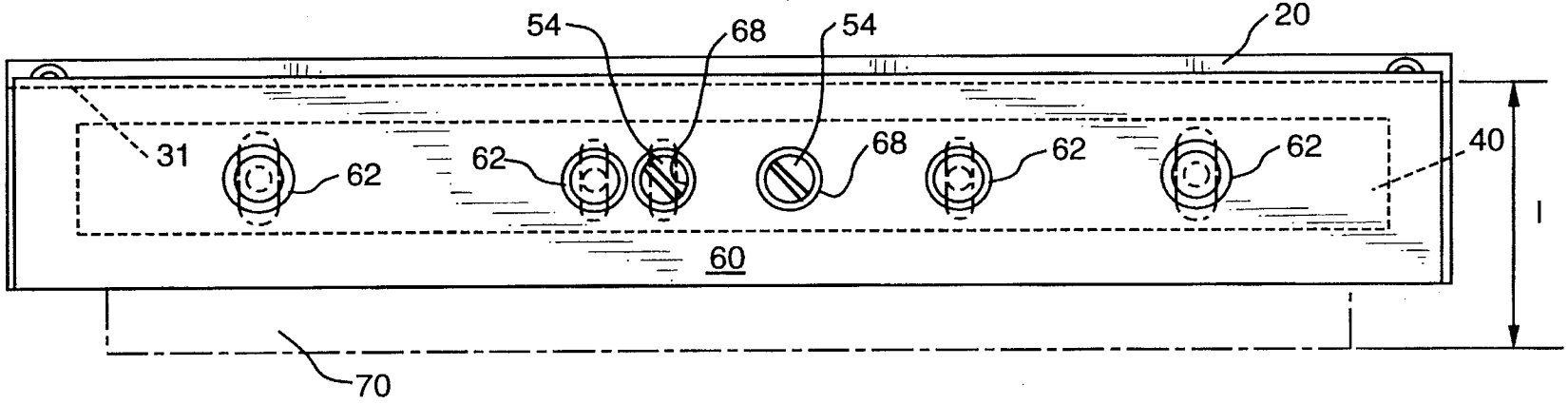
FIG. 3 is a top assembly view of a preferred tool fixture of the present invention supporting blade in a sharpening orientation.

In a preferred embodiment, the tool(s) are retained on the base plate 20 by a retaining plate 60. Retaining plate 60 is preferably configured as shown in FIGS. 3 and 8 and is attached to the base plate 20 by a plurality of (preferably four) attachment screws 62 that extend through corresponding bores (not shown) in the retaining plate 60 and slots 64 in the positioning member 40. The outer or forward end of retaining plate 60 is preferably provided with an arcuate portion 66 adapted to engage and clamp the tool(s) to the base plate 20. However, other retaining plate configurations could also be successfully used for clamping tool(s) to the base plate 20 in a desired abrading orientation. Also, to enable screws 54 to be accessed during the adjustment of positioning member 40 without removing the retaining plate 60 therefrom, the retaining plate 60 is preferably provided with screw access bores 68 as shown in FIGS. 3 and 8.

The operation of the present tool fixture 10 can be understood from reference to FIGS. 6 and 8 which depict the present tool fixture 10 supporting a tool 70 thereon in a predetermined abrading orientation. For the purposes of this example, tool 70 could comprise a typical jointer or planer blade; however, other similarly shaped tools may also be accommodated. The skilled artisan will appreciate, however, that the tool fixture 10 could also simultaneously support several "like-sized" tools (i.e., tools having substantially the same width "D" and thickness "E") clamped in a serial arrangement on the base plate 20. See FIG. 8. It will be further appreciated that, while the present tool fixture 10 is well-adapted to simultaneously support a plurality of like-sized tools, it is conceivable that the present tool fixture 10 could also simultaneously support tools that have different widths "D" and/or thicknesses "E" by utilizing pieces of shim stock (not shown) to compensate for the different tool widths and thicknesses. For example, the fixture 10 could be adjusted to clamp the largest tool and a piece of shim stock could be inserted between the positioning member and the tool to compensate for the difference in the tool widths and a second piece of shim stock could be placed between the thinner tool and the retaining plate 60 to permit the thinner tool to be simultaneously clamped to the base plate 20 with the thicker tool.

The tool 70 has a cutting edge 72 and a heel 74. The tool 70 is installed in the tool fixture 10 by first loosening or removing the screws 62 that secure the retaining plate 60 to the base plate 20. Thereafter, the tool 70 is positioned on the base plate 20 such that the heel 74 abuts the front abutment edge 42 of the positioning member 40. See FIGS. 6 and 8. The screws 54 that secure the positioning member 40 to the base plate 20 are then loosened to permit the positioning member 40 to be advanced or retracted on the base plate 20 to a desired position. The reader will understand that advancement screw 52 is advanced or retracted to cause the positioning member 40 to move on the base plate 20 such that the cutting edge 72 of the tool 70 is a desired distance "F" from the front edge 24 of the base plate 20. The skilled artisan will appreciate that the distance "F" will vary depending upon the type of tool rest and abrading apparatus utilized. It will be further appreciated that the alignment member 44 and groove 34, in cooperation with the springs 48, serve to keep the abutment edge 42 of the positioning member 40 from substantially skewing as the positioning member 40 is advanced or retracted on the base plate 20. It will be further understood that the groove 34 and the alignment member 44 could be machined such that a very small amount of clearance (i.e., 0.005") is provided therebetween. In such arrangement, the tension springs 48 could be omitted because the interrelationship between the groove 34 and the alignment member 44 would serve to prevent the positioning member 40 from substantially skewing as it is advanced or retracted on the base plate 20. The skilled artisan will appreciate, however, that the positioning member of the "spring-less" embodiment cannot be automatically retracted. Thus, the positioning member in that embodiment must be manually retracted.

After the positioning member 40 has been moved to the desired position, the screws 54 are lightly tightened to retain the positioning member 40 in that position. Thereafter, the entire heel 74 of the tool 70 is abutted against the front abutment edge 42 of the positioning member 40 and the screws 62 are lightly tightened to cause the retaining plate 60 to clamp the tool 70 in that orientation.

After the tool 70 has been installed in the above-mentioned manner, the tool fixture 10 is then placed on the rest member 19 of the tool platform 18. It will be appreciated that the tool rest member 19 has been preadjusted relative to the abrading medium (i.e., grinding wheels 15 or 16) such that when the subject tool fixture 10 is placed thereon, the tool 70 can be brought into uniform engagement with the abrasion surface (15' or 16') thereof. In particular, the downwardly extending tab 29 of the base plate 20 is hooked over the edge of the tool rest member 19 to thereby properly align the base plate 20 thereon and enable the fixture 10 to be laterally slidably displaceable on the tool rest member 19 in the directions depicted by arrow "G" in FIG. 1. When the base plate 20 is properly received on the tool rest member 19, screws 54 and 62 are loosened to permit the cutting edge 72 to be brought into engagement with, for example, the abrasive surface 15' of grinding wheel 15. See FIG. 2. The skilled artisan will appreciate that the cutting edge 72 of tool 70 is brought into such engagement with the abrasive surface 15' by advancing screw 52 until the slider plate 40 causes the cutting edge 72 to contact the abrasion surface 15'. Thereafter, screws 54 and 62 are tightened to secure tool 70 in that predetermined abrading orientation. It will therefore be appreciated that, as used herein, "predetermined abrading orientation" means the orientation of a tool 70 on the tool fixture 10 that permits the cutting edge 72 thereof to be substantially uniformly abraded when the base plate 20 is operably supported on a tool rest member 19 of a tool platform 18 that is operably attached to a tool abrading apparatus 14. Such arrangement permits the tool fixture 10 to be slidably displaced in directions depicted by arrow "G" in FIG. 1 to cause the entire cutting edge 72 of tool 70 to be uniformly abraded.

The skilled artisan will further appreciate that tab 29 serves to position the tool fixture 10 on the tool rest member 19 of the tool platform 18 such that the cutting edge 2 of the tool 70 is maintained in a substantially parallel relationship with respect to the inner surface 31 of tab 29. More particularly, tab 29 has a vertically extending orientation surface 31. The present positioning member 40 arrangement enables the tool 70 to be advanced on the base plate 20 such that the cutting edge 72 thereof is maintained in a substantially parallel relationship with the orientation surface 31 of tab 29. That is, as shown in FIG. 3, the distances "H" and "I" are always substantially equal when the positioning member 40 is advanced in the direction depicted by arrow "J" by turning advancement screw 52. To accommodate a tool with a larger width "D", screws 54 are loosened and advancement screw 52 is adjusted to cause the positioning member 40 to be urged in a rearward direction (depicted by arrow "B" in FIG. 6) by springs 48. After positioning member 40 has been repositioned on base 20, the screws 62 are loosened to permit the wider tool to be inserted between base 20 and retaining plate 60. In the alternative, the retaining plate 60 may be totally removed from the base 20 to permit the tool to be positioned in an abutting relationship with the positioning member 40. After the tool has been initially positioned on the base member 20, the tool fixture 10 is placed on the tool rest member 19 and the cutting edge 72 of the tool 70 is brought into final engagement with the abrading surface of an abrading medium in the above-discussed manner.

Thus, the present tool fixture serves to retain and orient a tool or blade in a fixed position such that when the tool fixture is place on a corresponding tool platform, the cutting edge of the tool can be uniformly sharpened along its entire length. The unique positioning member arrangement of the present invention enables the tool or blade to be properly positioned on the base plate such that the edge to be sharpened is parallel with respect to the inner surface 31 of the tab 29 by adjusting a single positioning screw 52. Also, the tension springs 48 serve to automatically retract the positioning member 40 in a rearward direction when the positioning screw 52 is advanced out of bore 25.

Accordingly, the present invention provides solutions to the aforementioned problems associated with other tool fixtures or holders. It will be understood, however, that various changes in the details, materials and arrangements of parts which have been herein described and illustrated in order to explain the nature of the invention may be made by those skilled in the art within the principle and scope of the invention as expressed in the appended claims.

What is claimed is:

1. Apparatus for holding a tool having a cutting edge in a predetermined abrading orientation with respect to a tool abrading apparatus, comprising:

base means for supporting the tool thereon, said base means being removably supported by the tool abrading apparatus;

a positioning member movably attached to said base means for selective abutting contact with the tool;

adjustment means attached to said base means for selectively advancing and retracting said positioning member relative to said base means to move the tool into the predetermined abrading orientation; and tool retaining means removably attached to said base means for selectively retaining the tool on said base means such that the tool is retained in the predetermined abrading orientation.

2. The apparatus of claim 1 wherein said base means further comprises guide means attached to said base means for slidably retaining said base means on the tool abrading apparatus such that said base means can be laterally slidably displaced thereon while retaining the tool in the predetermined abrading orientation.

3. The apparatus of claim 2 wherein said guide means defines an orientation plane and wherein the cutting edge of the tool supported on said base means will be substantially parallel with said orientation plane when the tool is in the predetermined abrading orientation.

4. The apparatus of claim 3 wherein said adjustment means comprises:

at least one selectively advanceable and retractable screw member threadedly attached to said base means for selective advancement of said positioning member relative to said base means to move the tool into the predetermined abrading orientation and selective retraction to permit said positioning member to be rearwardly retracted on said base means; and means for urging said positioning member in a rearward direction when each said screw member is retracted.

5. The apparatus of claim 4 wherein said means for urging comprises a first spring member attached to said base means and a first lateral end of said positioning member and a second spring member attached to said base means and a second lateral end of said positioning member, said first and second spring members retracting said positioning member on said base means when each said screw member is retracted.

6. The apparatus of claim 5 wherein said adjustment means further comprises a groove provided in said base means adapted to slidably receive therein an alignment member attached to said positioning member, said groove and alignment member cooperating with said first and second springs to restrict the advancement and retraction of said positioning member to a predetermined path of travel to enable said positioning member to orient the tool in the predetermined abrading orientation.

7. Apparatus for holding a tool having a cutting edge in a predetermined abrading orientation with respect to a tool abrading apparatus, comprising:

base means for supporting the tool thereon, said base means being removably supported on the tool abrading apparatus;

a positioning member movably attached to said base means for selective abutting contact with the tool;

a single advanceable and retractable adjustment member attached to said base means for selectively forwardly advancing said positioning member relative to said base means to move the tool into the predetermined abrading orientation; and tool retaining means removably attached to said base means for selectively retaining the tool on said base means such that the tool is retained in the predetermined abrading orientation.

8. The apparatus of claim 7 wherein said base means further comprises guide means attached to said base means for slidably retaining said base means on the tool abrading apparatus such that said base means can be laterally slidably displaced on said tool abrading apparatus while retaining the tool in the predetermined abrading orientation.

9. The apparatus of claim 7 further comprising means for urging said positioning member in a rearward direction when said adjustment member is retracted.

10. The apparatus of claim 9 wherein said means for urging comprises a first spring member attached to said base means and a first lateral end of said positioning member and a second spring member attached to said base means and a second lateral end of said positioning member, said first and second spring members retracting said positioning member on said base means when said adjustment member is retracted.

11. The apparatus of claim 10 additionally comprising a groove provided in said base means adapted to slidably receive therein an alignment member attached to said positioning member, said groove member and alignment member cooperating with said first and second springs to restrict the advancement and retraction of said positioning member to a predetermined path of travel to enable said positioning member to orient the tool in said predetermined abrading orientation.

12. Apparatus for holding a tool having a cutting edge in a predetermined abrading orientation with respect to a tool abrading apparatus, comprising:

base means for supporting the tool thereon, said base means having a tab member formed thereon for slidably retaining said base means on the tool abrading apparatus such that said base means can be laterally slidably displaced on said tool abrading apparatus while retaining the tool in the predetermined abrading orientation, said base means further having a groove therein;

an advanceable and retractable positioning member movably attached to said base means for selective abutting contact with the tool, said positioning member having an alignment member sized to be slidably received in said groove to restrict the advancement and retraction of said positioning member to a predetermined path of travel to enable said positioning member to orient the tool in the predetermined abrading orientation;

adjustment means attached to said base means for selectively advancing and retracting said positioning member relative to said base means to move the tool into the predetermined abrading orientation; and tool retaining means removably attached to said base member for selectively retaining the tool on said base member such that the tool is retained in the predetermined abrading orientation.

* * * * *

UNITED STATES PATENT AND TRADEMARK OFFICE

CERTIFICATE OF CORRECTION

PATENT NO. : 5,545,081
DATED : August 13, 1996
INVENTOR(S) : Jeffrey L. Haffely, Xun Lei and Louis C. Brickner It is certified that error appears in the above-indentified patent and that said Letters Patent is hereby corrected as shown below:

Col. 4, line 45, delete "08/286,375 and substitute therefor --08/286,357--.

Col. 7, line 36, delete "2" and substitute therefor --72--.

Signed and Sealed this

Seventh Day of January, 1997

Bruce Lehman

*Attest:*

BRUCE LEHMAN

*Attesting Officer*

*Commissioner of Patents and Trademarks*